United States Patent [19]

Green

[11] Patent Number: 4,885,504

[45] Date of Patent: Dec. 5, 1989

[54] HOLLOW CATHODE ASSEMBLY AND LAMP

[75] Inventor: James G. Green, Pakenham Upper, Australia

[73] Assignee: Photron Pty. Ltd., Victoria, Australia

[21] Appl. No.: 96,884

[22] PCT Filed: Oct. 29, 1986

[86] PCT No.: PCT/AU86/00325

§ 371 Date: Jul. 28, 1987

§ 102(e) Date: Jul. 28, 1987

[87] PCT Pub. No.: WO87/03422

PCT Pub. Date: Jun. 4, 1987

[30] Foreign Application Priority Data

Nov. 28, 1985 [AU] Australia ..... PH3629

[51] Int. Cl.[4] ..... H01J 61/09

[52] U.S. Cl. ..... 313/618; 313/632; 313/613; 313/614; 313/605; 313/606; 313/590

[58] Field of Search ..... 313/618, 631, 632, 613, 313/614, 615, 605, 606, 590

[56] References Cited

U.S. PATENT DOCUMENTS

| | | | |
|---|---|---|---|
| 1,841,289 | 1/1932 | Jenks, Jr. | 313/306 |
| 1,888,670 | 11/1932 | Hotchner | 313/605 X |
| 2,457,891 | 1/1949 | Henninger et al. | 313/590 X |
| 2,473,833 | 6/1949 | Stutsman | 313/614 X |
| 3,855,491 | 12/1974 | Yamasaki | 313/618 X |
| 4,339,691 | 7/1982 | Morimiya et al. | 313/618 X |
| 4,698,550 | 10/1987 | Kobayashi et al. | 313/618 |

OTHER PUBLICATIONS

Author: Lowe, "A High Intensity Hollow Cathode Lamp for Atomic Fluorescence"; *Spectrochimica Acta.;* vol. 26B, 12-1971, pp. 201-205.

*Primary Examiner*—Donald J. Yusko
*Assistant Examiner*—Michael Horabik
*Attorney, Agent, or Firm*—Sughrue, Mion, Zinn, Macpeak & Seas

[57] ABSTRACT

A hollow cathode assembly especially suitable for a boosted discharge hollow cathode lamp includes, a hollow cathode open at spaced apart ends, formed from a selected element which characterizes the assembly, and a cathode support. An anode is spaced from one of the open ends of the cathode, while an electron emitter has its outlet spaced from the other open end of the cathode. An inner envelope is provided to constrain the electron stream from the electron emitter to the anode to pass through the cathode. The cathode support is not insulated to prevent surface discharge therefrom but in operation of the lamp, the stream of electrons from the electron emitter through the cathode to the anode substantially confines surface discharge to the interior of the cathode.

6 Claims, 1 Drawing Sheet

HOLLOW CATHODE ASSEMBLY AND LAMP

This invention relates to hollow cathode assemblies, particularly but not exclusively when mounted within an envelope to form a boosted discharge hollow cathode lamp.

A prior-described form of boosted discharge hollow cathode lamp comprises an open-ended cylindrical cathode of the element selected to characterize the lamp, supported centrally within a glass envelope. An anode is spaced from one of the open ends of the cathode and an electron emitter has its outlet aperture adjacent and to the side of the other open end. This lamp is a modification of an earlier boosted discharge lamp in which an electron emitter directed a stream of electrons above and across the open top of a cup-shaped electrode. The purpose of the electron stream was to boost the proportion of atomic species which attained an excited energy state. The later lamp, in which the electron stream passes through the cathode to the anode, has been more successful in achieving this object but is expensive to manufacture because of the requirement for multiple insulating baffles about the cathode to isolate the cathode support structure and associated current conductors. Such baffles are necessary to prevent discharge from surfaces other than the interior of the cathode, for example from the external cylindrical surface of the cathode and the exposed surfaces of the support structure. Such extraneous discharges sputter contaminating species into the neon/elemental vapour.

The present invention is based upon the realization that the stream of electrons passing through the cathode from the electron emitter to the anode is capable alone, if at an adequate level, of confining surface discharge to the interior of the cathode.

The invention accordingly provides a hollow cathode assembly comprising a hollow cathode, open at spaced apart ends, formed of a selected element which characterizes the assembly, means supporting the hollow cathode, an anode spaced from one of said open ends of the cathode, electron emission means with its outlet spaced from the other open end of the cathode, and means to constrain the electron stream from said emission means to the anode to pass through the cathode, wherein said cathode support means is not isolated to prevent surface discharge therefrom but in operation of the lamp the stream of electrons from the electron emission means through the cathode to the anode substantially confines surface discharge to the interior of the cathode.

The invention further provides a boosted discharge hollow cathode lamp comprising an outer transparent envelope usually filled with an inert gas, and, within the envelope:

- a hollow cathode, open at spaced apart ends, formed of a selected element which characterizes the lamp;
- means supporting the hollow cathode;
- an anode spaced from one of said open ends of the cathode;
- electron emission means with an outlet spaced from the other open end of the cathode; and
- means to constrain the electron stream from said emitter to the anode to pass through the cathode;
- wherein said cathode support means is not isolated to prevent surface discharge therefrom but in operation of the lamp, by application of a sufficient voltage between the cathode and anode to generate a discharge for causing cathodic sputtering of said element, the stream of electrons from the electron emission means through the cathode to the anode substantially confines surface discharge to the interior of the cathode.

Preferably, said anode is disposed within an inner envelope which is typically transparent and has an open end in close proximity to said one open end of the cathode. Advantageously, this open end of the inner envelope is dimensioned to provide an annular opening from the interior of the inner envelope about the hollow cathode, which annular opening is small enough to act as an insulator to substantially prevent discharge occuring around the cathode.

There may be further provided within the envelope one or more electrical conductors in electrical contact with the cathode, either directly or indirectly, which conductors are likewise not isolated to prevent surface discharge therefrom, since the stream of electrons from the electron emission means to the anode substantially confines surface discharge to the interior of the cathode.

The invention will be further described, by way of example only, with reference to the accompanying drawings, in which.

Figure 1:
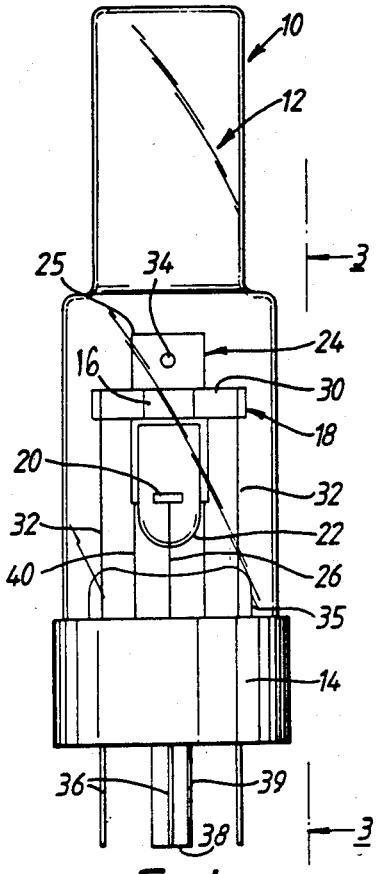
FIG. 1 is a side elevation of a boosted discharge hollow cathode lamp constructed in accordance with the invention.

The illustrated lamp 10 includes an outer stepped tubular envelope 12 of transparent borosilicate glass hermetically sealed into a feedthrough base plug 14 after the envelope has been filled with a suitable inert gas such as neon.

Inside the envelope 12 are disposed an open-ended hollow cylindrical cathode 16 of the selected element characterizing the lamp, held co-axially centrally in the envelope by a tantalum support 18, an anode 20 displaced from the open bottom end (as illustrated) of cathode 16 within an inner borosilicate transparent glass envelope 22, and an electron emitter 24. Inner envelope 22 is closed at its lower end by being sealed about an electrically conductive rod 26 depending from anode 20. The inner envelope is open at its top end, providing an opening of sufficient width to leave a fine annular opening 28 from the interior of envelope 22 (e.g. 0.4 mm) about cathode 16 and its support 18. At the normal operating pressure in the lamp, substantially no discharge can occur in an opening this small, and thus the opening 28 acts as an insulator to substantially prevent discharge occuring around the cathode.

Cathode support 18 comprises a pair of tantalum strips 19 formed about the cathode and spot welded together to define oppositely directed tabs 30. Secured to and depending from these tabs are respective conductive rods 32 for supplying electrical current to activate the cathode.

Electron emitter 24 is of a known design and is housed within a titanium shield 25 with its emission outlet port 34 just above and spaced laterally of the open top of cathode 16.

Figure 2:
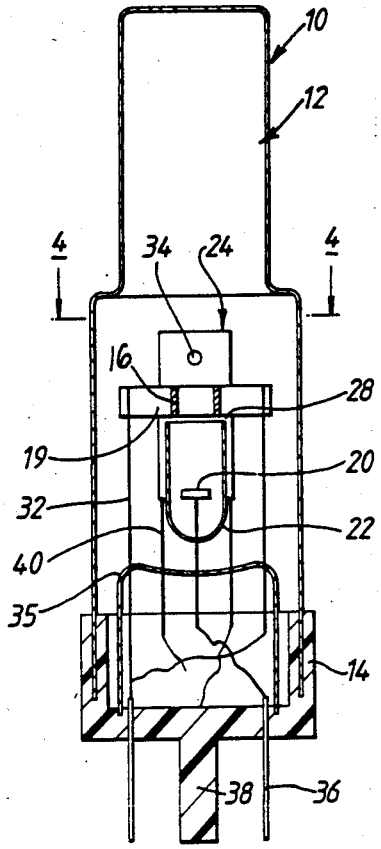
FIG. 2 is an axial cross-section parallel to the view of FIG. 1.
Figure 3:
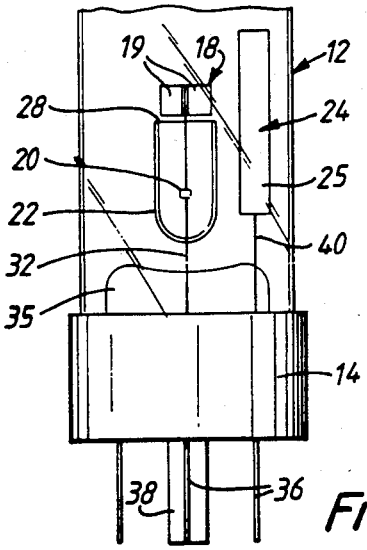
FIG. 3 is a further side elevation on the line 3—3 in FIG. 1.
Figure 4:
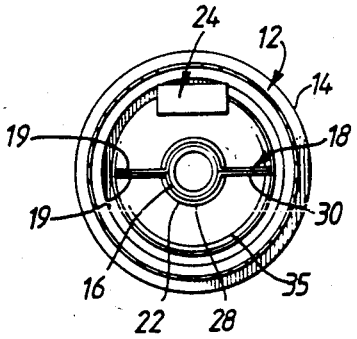
FIG. 4 is a transverse cross-section on the line 4—4 in FIG. 2.

Conductive rods 26, 32 and a pair of current leads 40 for emitter 24 pass through an upstanding glass platform 35 which therefore provides a mount fixedly locating the assembly within the envelope. Conductive rods 32 are electrically joined below this mount (FIG. 2) and the resultant four conductors are soldered to four conductive pins 36 which sealingly project through base plug 14. Pins 36 are arranged about a depending integral prong 38 by which the lamp base is located in a matching socket. Prong 38 has a side rib 39 for fixing the rotational position of the lamp. The matching socket will include complementary contacts for pins 36.

In operation of the lamp, a suitable high voltage emf is applied between the hollow cathode and the anode. The resultant discharge causes cathodic sputtering of the element of the cathode and the consequent production of a vapour of the element within and about the cathode. Indeed, if the electron emitter is not activated, surface discharge is clearly visible from surfaces of the cathode support 18 and conductor rods 32 as well as from the interior of the cathode. Such extraneous discharge both decreases the intensity of the lamp and contaminates the vapour, and is therefore highly undesirable for photometric work, e.g. atomic absorption spectroscopy, in which the lamp constitutes the primary light source.

On activation of electron emitter 24 to an adequate current level, an electron stream is formed between the emitter and the anode but is constrained to pass through the cathode by inner envelope 22. This stream is effective both as a second discharge to further excite species in the vapour (and so boost the performance, i.e. intensity, of the lamp) and, in accordance with the invention, to confine surface discharge to the interior of hollow cathode 16. Indeed, it is observed that, where the emf has earlier been applied between the cathode and anode in the absence of emission from emitter 24, the discharge evident on the surfaces of the cathode support 18 and conductive rod 32 diminishes and eventually ceases as the current from emitter 24 is increased. It is believed that the optimum emitter current for maximising excitation of the vapour species from their ground state (i.e. to achieve maximum lamp intensity) is substantially equal to the minimum emitter current for confining surface discharge substantially wholly to the interior of the cathode.

The lamp acquires a steady state in which atoms of the characteristic element are sputtered from the interior surface of the cathode and the elemental atoms and neon atoms of the vapour are excited by the emission current. Although there are no baffles or insulating devices isolating other potential discharge surfaces such as support 18 and conductive rods 32, substantially no other surface discharge occurs.

By way of example, a copper hollow cathode lamp of the illustrated design typically requires a cathode current of 5 mA and an emitter or boost current of 20 mA to achieve performance in accordance with the invention. Corresponding values for lead and bismuth lamps are 5/10 mA and 10/80 mA respectively.

It is found that the lamp of the invention exhibits a further significant advantage in that there is little evidence of the gradual entrapment of neon molecules in the internal surface of the cathode. Such entrapment is the dominant factor limiting the life of conventional hollow cathode lamps as it causes a gradual diminishment of the neon within the envelope.

I claim:

1. A boosted discharge hollow cathode assembly comprising a hollow cathode, open at spaced apart ends, formed of a selected element which characterizes the assembly;

means supporting the hollow cathode;

an anode spaced from one of said open ends of the cathode;

electron emission means having an electron emission outlet spaced from the other open end of the cathode; and means to constrain an electron stream from said emission outlet to the anode to pass through the cathode;

wherein said cathode support means is not insulated to prevent surface discharge therefrom but in operation of the assembly within a lamp envelope, by application of a sufficient voltage between the cathode and anode to generate a discharge for causing cathodic sputtering of said selected element, the electron stream from the electron emission means through the cathode to the anode substantially confines surface discharge to the interior of the cathode, and wherein said constraining means comprises an inner transparent envelope which is disposed about said anode and has an open end in close proximity to said one open end of the cathode.

2. A boosted discharge hollow cathode assembly according to claim 1 wherein said open end of the inner envelope is dimensioned to provide a small annular opening from the interior of the inner envelope about the hollow cathode, which annular opening is small enough to act as an insulator to substantially prevent discharge occurring around the cathode.

3. A boosted discharge hollow cathode lamp comprising an outer transparent envelope and, within the envelope:

a hollow cathode, open at spaced apart ends, formed of a selected element which characterizes the lamp;

means supporting the hollow cathode;

an anode spaced from one of said open ends of the cathode;

electron emission means having an electron emission outlet spaced from the other open end of the cathode; and means to constrain an electron stream from said emission outlet to the anode to pass through the cathode;

wherein said cathode support means is not insulated to prevent surface discharge therefrom but in operation of the lamp, by application of a sufficient voltage between the cathode and anode to generate a discharge for causing cathodic sputtering of said selected element, the electron stream from the electron emission means through the cathode to the anode substantially confines surface discharge to the interior of the cathode, and wherein said constraining means comprises an inner transparent envelope which is disposed about said anode and has an open end in close proximity to said one open end of the cathode.

4. A booster discharge hollow cathode lamp according to claim 3, wherein said open end of the inner envelope is dimensioned to provide an annular opening from the interior of the inner envelope about the hollow cathode, which annular opening is small enough to act as an insulator to substantially prevent discharge occurring around the cathode.

5. A boosted discharge hollow cathode lamp according to claim 3, further comprising within the outer transparent envelope one or more electrical conductors in electrical contact with the cathode, at least indirectly, which conductors are likewise not insulated to prevent surface discharge therefrom, since the stream of electrons from the electron emission means to the anode substantially confines surface discharge to the interior of the cathode.

6. A boosted discharge hollow cathode lamp according to claim 3 wherein said outer envelope is filled with an inert gas.

* * * * *